US012616911B1

(12) United States Patent
Chen

(10) Patent No.: US 12,616,911 B1
(45) Date of Patent: May 5, 2026

(54) FRAME, ASSEMBLING PANEL, AND ASSEMBLY TOY

(71) Applicant: Jun Chen, Guangzhou (CN)

(72) Inventor: Jun Chen, Guangzhou (CN)

( * ) Notice: Subject to any disclaimer, the term of this patent is extended or adjusted under 35 U.S.C. 154(b) by 0 days.

(21) Appl. No.: 19/310,723

(22) Filed: Aug. 26, 2025

(30) Foreign Application Priority Data

Jun. 12, 2025 (CN) ..... 202521205363.9

(51) Int. Cl.
*A63H 33/04* (2006.01)
*A63H 33/06* (2006.01)
*A63H 33/00* (2006.01)

(52) U.S. Cl.
CPC ..... *A63H 33/046* (2013.01); *A63H 33/062* (2013.01); *A63H 33/008* (2013.01); *A63H 33/044* (2013.01)

(58) Field of Classification Search
CPC .. A63H 33/046; A63H 33/062; A63H 33/008; A63H 33/044
USPC ..... 446/92, 129–139, 478
See application file for complete search history.

(56) References Cited

U.S. PATENT DOCUMENTS

| | | | | |
|---|---|---|---|---|
| 9,643,100 | B2 * | 5/2017 | Fein | A63H 33/046 |
| 9,713,777 | B2 * | 7/2017 | Peterson | B29C 65/56 |
| 10,258,896 | B2 * | 4/2019 | Ornstein | A63H 33/06 |
| 11,527,344 | B2 * | 12/2022 | Kuo | E04B 1/612 |
| 12,370,459 | B1 * | 7/2025 | Anderson | A63H 33/046 |
| 2014/0302741 | A1 * | 10/2014 | Whittaker | A63H 33/046 446/92 |
| 2016/0184727 | A1 * | 6/2016 | Ornstein | A63H 33/046 446/92 |
| 2020/0246715 | A1 * | 8/2020 | Bensussan | A63H 33/10 |

* cited by examiner

*Primary Examiner* — Nini F Legesse
(74) *Attorney, Agent, or Firm* — Tsz Lung Yeung

(57) ABSTRACT

A magnetic assembling panel includes an assembling panel and a frame for framing the assembling panel. The frame includes at least one magnetic element and a frame body having a receiving cavity receiving the magnetic element therein and a position limiting space formed at an inner edge of the frame body to receive an edge of the assembling panel. The frame includes a lower frame having a first mounting groove and a second mounting groove, and an upper frame having a third mounting groove and a fourth mounting groove. When the upper frame and the lower frame are coupled with each other, the first mounting groove and the third mounting groove form the receiving cavity to receive the magnetic element while the second mounting groove and the fourth mounting groove form the position limiting space to receive the edge of the assembling panel.

18 Claims, 9 Drawing Sheets

FRAME, ASSEMBLING PANEL, AND ASSEMBLY TOY

CROSS REFERENCE OF RELATED APPLICATION

This is a non-provisional application that claims priority under 35 U.S.C. 119 to foreign application No. 2025212053639, filed Jun. 12, 2025 in China. The aforementioned patent application is hereby incorporated by reference in its entirety.

BACKGROUND OF THE PRESENT INVENTION

Field of Invention

The present invention relates to a toy, and more particularly to a frame, an assembling panel, and an assembly toy.

Description of Related Arts

With the continuous growth of the educational toy market for children, magnetic panel assembly toys, which combine fun and creativity, have gained widespread popularity among consumers. These toys allow children to freely connect the magnetic panels and build a variety of shapes, fostering imaginative play. The magnetic panel assembly toy generally comprises a magnetic mechanism and a plurality of blocking plates, wherein the magnetic mechanism is arranged for the connections between the blocking plates while the blocking plate serves as the assembly interface of other blocking plates. Through these components, i.e., the magnetic mechanism and the blocking plates, children can construct diverse forms such as playhouses and creative structures. However, such existing magnetic panel assembly toys often feature complex designs and cumbersome assembling processes.

SUMMARY OF THE PRESENT INVENTION

Certain variations of the present invention provide a frame, an assembling panel, and an assembly toy, aimed at improving the assembly efficiency of magnetic panels.

Certain variations of the present invention provide a frame which comprises a frame body having a first receiving cavity and a position limiting space formed on an inner side of the frame body for panel assembling, and a magnetic element arranged within the first receiving cavity.

In one aspect of the present invention, it provides a magnetic assembling panel, comprising:

an assembling panel; and a frame for framing the assembling panel, wherein the frame comprises at least one magnetic element, and a frame body having a receiving cavity receiving the magnetic element therein and a position limiting space formed at an inner edge of the frame body to receive an edge of the assembling panel;

wherein the frame body comprises:

a lower frame having a first mounting groove and a second mounting groove;

an upper frame having a third mounting groove and a fourth mounting groove; and an interlock mechanism interlocking the upper frame and the lower frame with each other, wherein when the upper frame and the lower frame are coupled with each other, the first mounting groove and the third mounting groove form the receiving cavity while the second mounting groove and the fourth mounting groove form the position limiting space to receive the edge of the assembling panel.

This summary presented above is provided merely to introduce certain concepts and not to identify any key or essential features of the claimed subject matter.

DETAILED DESCRIPTIONS OF THE PRESENT INVENTION

Figure 1:
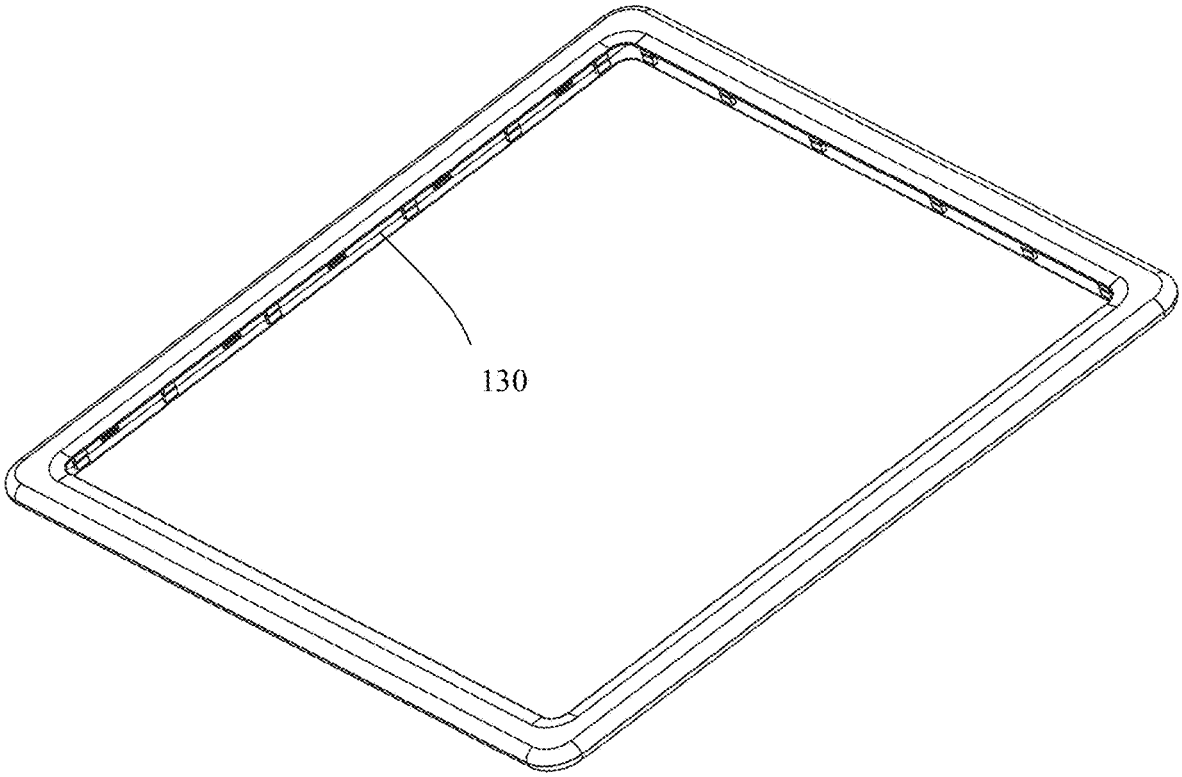
FIG. 1 is a schematic view of a frame of an assembly toy according to a preferred embodiment of the present invention.
Figure 2:
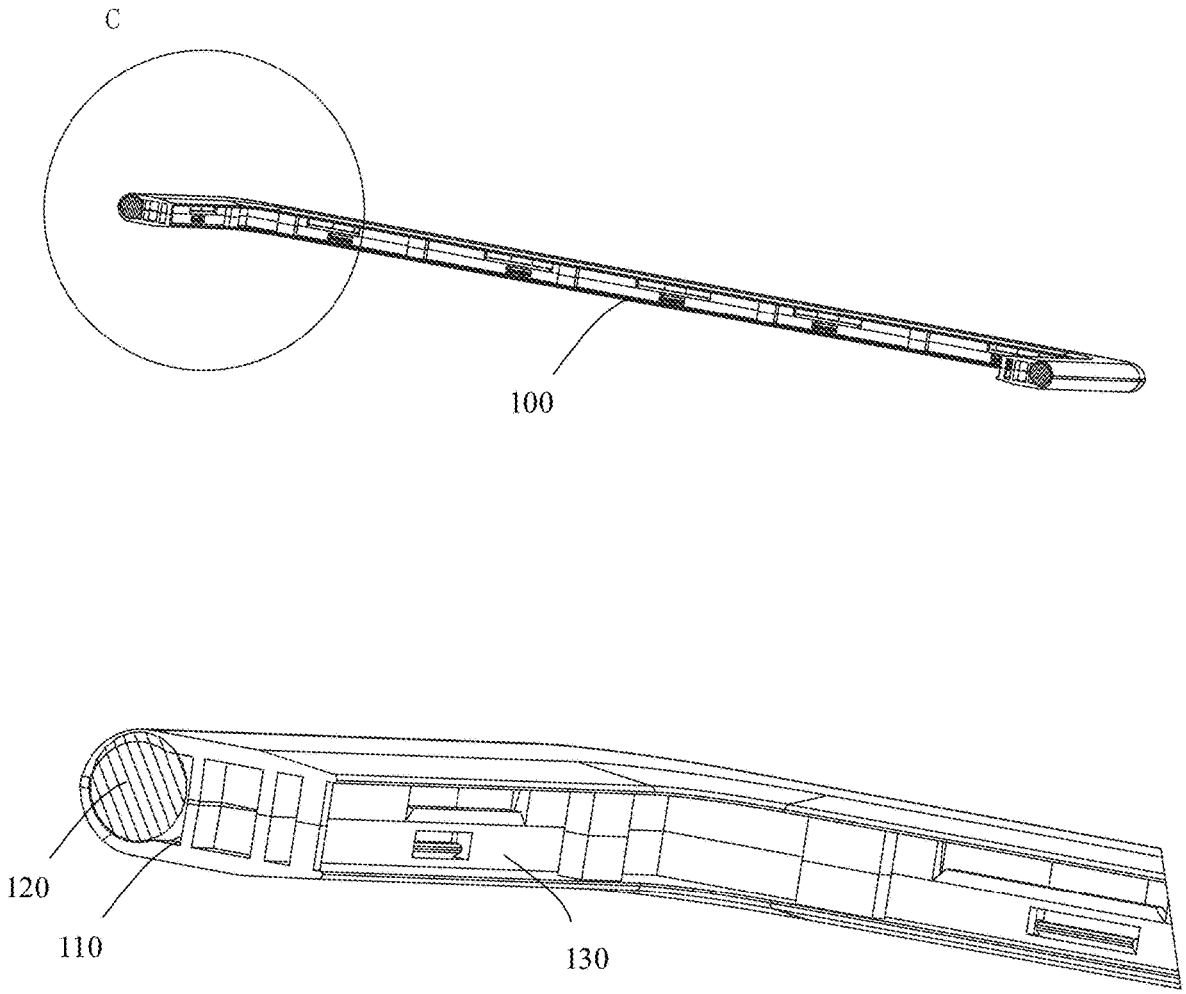
FIG. 2 is a sectional view of the frame of the assembly toy according to the above preferred embodiment of the present invention.

The following detailed description of the preferred embodiment is the preferred mode of carrying out the invention. The description is not to be taken in any limiting sense. It is presented for the purpose of illustrating the general principles of the present invention.

In the following descriptions, it should also be appreciated that the terms "arrange" and "set" in the following description refer to the connecting relationship in the accompanying drawings for easy understanding of the present invention. For example, the "arrange" and "set" may refer to one element directly or indirectly set or arrange on another element. Therefore, the above terms should not be an actual connection limitation of the elements of the present invention.

It should also be appreciated that the terms "center", "length", "width", "thickness", "top", "bottom", "front", "rear", "left", "right", vertical", "horizontal", "upper", "lower", "interior", and "exterior" in the following description refer to the orientation or positioning relationship in the accompanying drawings for easy understanding of the present invention without limiting the actual location or orientation of the present invention. Therefore, the above terms should not be an actual location limitation of the elements of the present invention.

Moreover, it should be appreciated that the terms " ", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of the present invention.

It should be appreciated that the terms "install", "connect", "couple", and "mount" in the following description refer to the connecting relationship in the accompanying drawings for easy understanding of the present invention. For example, the connection may refer to permanent connection or detachable connection. Therefore, the above terms should not be an actual connection limitation of the elements of the present invention.

With the continued growth of the children's educational toy market, magnetic panel assembly toy 300, which combines entertainment and creativity, has gained strong consumer appeal for allowing children to freely connect components and build a variety of imaginative structures. The magnetic panel assembly toy 300 comprises a magnetic mechanism and a plurality of assembling panels 200. The magnetic mechanism is arranged for the connection between the blocking plates. The assembling panel serves as the assembly interface of other assembling panels. Through these components, i.e., the magnetic mechanism and the assembling panels, children can construct diverse forms such as playhouses and creative structures. However, as discussed above, the existing magnetic panel assembly toy often feature complex structures and cumbersome assembly processes.

During the assembly process, the connection between a frame and the assembling panel 200 often relies on traditional snap-fit or adhesive bonding techniques. The snap-fit structures are prone to loosening and buckle breakage after repeated insertion and removal, resulting in reduced overall plate stability. The adhesive bonding, on the other hand, is affected by glue performance and application uniformity, leading to low assembly efficiency. Over time, glue aging may cause the blocking plate 200 to detach from the frame. Moreover, conventional assembly process lacks effective control over the integration of magnetic component 120. Poor compatibility between the magnetic element 120 and the frame or assembling panel 200 can result in misalignment, uneven magnetic force, and other issues that negatively impact the toy's assembly experience and service life. These shortcomings make it difficult to meet market demands for high-quality magnetic panel assembly toys 300.

The present invention provides a frame according to one embodiment.

Referring to FIG. 1, FIG. 2, and FIG. 4 to FIG. 8 of the drawings, in one embodiment, the present invention may comprise a frame body 100 having a first receiving cavity 110, and one or more magnetic elements 120 disposed in the first receiving cavity 110. The frame body 100 may further have a position limiting space 130 defined at an inner edge of the frame body 100 for panel assembly.

The technical solution of the present invention improves assembly efficiency by configuring the first receiving cavity 110 on the frame body 100, wherein the magnetic element 120 may be disposed therewithin while the position limiting space 130 may be defined at the inner side of the frame body 100 for panel assembly. The assembly process may be completed efficiently, thereby enhancing the overall assembly performance of the magnetic panel.

Referring to FIG. 4 to FIG. 8 of the drawings, the frame body 100 may comprise a lower frame 140 and an upper frame 150.

The lower frame 140 may comprise a first mounting groove 141. The lower frame 140 may further comprise a second mounting groove 142 formed at an inner edge of the lower frame 140. The upper frame 150 may comprise a third mounting groove 151. The upper frame 150 may further comprise a fourth mounting groove 152 formed at an inner edge of the upper frame 150. The upper frame 150 may be detachably coupled with the lower frame 140. When the upper frame 150 and the lower frame 140 are coupled with each other, the third mounting groove 151 and the first mounting groove 141 together may form the first receiving cavity 110, while the fourth mounting groove 152 and the second mounting groove 142 together may form the position limiting space 130.

In the preferred embodiment, to address issues such as low assembly efficiency, poor structural stability, and insufficient compatibility of the magnetic element 120 in existing magnetic panels, the frame body 100 may adopt an assembling configuration constructed by the lower frame 140 and the upper frame 150. The assembly process may be simplified by placing an edge of the assembling panel 200 into either the second mounting groove 142 or the fourth mounting groove 152, and then coupling the upper frame 150 and the lower frame 140 to complete the assembly process. This structural configuration enables efficient assembly of the magnetic panel and significantly improves overall assembly performance.

Specifically, the first mounting groove 141 may be provided in the lower frame 140 while the second mounting groove 142 may be provided at the inner edge of the lower frame 140. Correspondingly, the third mounting groove 151 may be provided in the upper frame 150 while the fourth mounting groove 152 may be provided at the inner edge of the upper frame 150. When the upper frame 150 and the lower frame 140 are coupled with each other, the first mounting groove 141 of the lower frame 140 and the third mounting groove 151 of the upper frame 150 may together form the first receiving cavity 110, which provides a precise installation area for the magnetic element 120, ensuring its fixed position within the frame body 100 and accurate alignment with the magnetic mechanism of adjacent panels.

In other words, two assembling panels may be magnetically coupled with each other edge-to-edge via the magnetic elements 120. At the same time, the second mounting groove 142 of the lower frame 140 and the fourth mounting groove 152 of the upper frame 150 may form the position limiting space 130 at the inner edge of the frame body 100, which may serve to accommodate the edge of the assembling panel 200 as the assembling interface. The magnetic element 120 and the assembling panel 200 may be separated and secure in two independent spaces of the frame body 100. During actual assembly, the assembling panel 200 may simply be placed into either the second mounting groove 142 of the lower frame 140 or the fourth mounting groove 152 of the upper frame 150. Aligning and detachably connecting the upper frame 150 and the lower frame 140 then simultaneously may complete the positioning and installation of the magnetic element 120 and the fixation of the assembling panel 200 within the frame body 100. This frame assembling design, combined with the dual-groove configuration, may streamline multiple conventional steps, such as integrating the magnetic element 120 and securing the assembling panel 200, into a single alignment and engagement operation between the upper frame 150 and the lower frame 140, significantly reducing the overall assembly process.

The detachably connection structure of the upper frame 150 and the lower frame 140, through precise alignment of the mounting grooves, may provide dual constraint for the magnetic elements 120 and the assembling panel 200. The first receiving cavity 110, which may be formed by the combined structure of the upper frame 150 and the lower frame 140, may securely clamp each magnetic element 120 in a predetermined position, thereby avoiding misalignment and uneven magnetic force issues commonly seen in conventional designs. Meanwhile, the position limiting space 130, which may be formed by the inner mounting grooves of the upper frame 150 and the lower frame 140, may offer four-sided confinement for the assembling panel 200, ensuring stable and accurate panel integration.

This structural configuration may eliminate the detachment risks associated with adhesive aging in conventional bonding processes. Since the entire assembly requires no additional tools or adhesive steps, and relies solely on mechanical structural coordination, it significantly enhances production efficiency while ensuring the long-term structural stability of the magnetic panel.

Referring to FIG. 4 to FIG. 8 of the drawings, the lower frame 140 may further have a first mounting portion 143, a first sidewall 144 formed along one edge of the first mounting portion 143, and a second sidewall 145 formed at the opposite side of the first mounting portion 143, wherein the first sidewall 144, the second sidewall 145, and the first mounting portion 143 may form the first mounting groove 141 and the second mounting groove 142. In other words, the first mounting groove 141 may be formed between the first sidewall 144 and the second sidewall 145 while the second sidewall 145 may be formed between the first mounting groove 141 and the second mounting groove 142. In addition, a fifth mounting groove 146 may be formed in the first mounting groove 141.

The upper frame 150 may further have a second mounting section 153, a third sidewall 154 formed along one edge of the second mounting portion 153, and a fourth sidewall 155 formed at the opposite side of the first mounting portion 143, wherein the third sidewall 154, the fourth sidewall 155, and the second mounting portion 153 may form the third mounting groove 151 and the fourth mounting groove 152. In other words, the third mounting groove 151 may be formed between the third sidewall 154 and the fourth sidewall 155 while the fourth sidewall 155 may be formed between the third mounting groove 151 and the fourth mounting groove 152. Additionally, a sixth mounting groove 156 may be formed on the third mounting groove 151.

One end of the magnetic element 120 may be coupled at the fifth mounting groove 146, and an opposed end of the magnetic element 120 may be coupled at the sixth mounting groove 156.

According to the preferred embodiment of the present invention, the first sidewall 144 and second sidewall 145 may be respectively arranged on two sides of the first mounting portion 143 of the lower frame 140, in order to form the first mounting groove 141 and second mounting groove 142. The fifth mounting groove 146 may additionally be provided at the first mounting groove 141. Correspondingly, the third sidewall 154 and fourth sidewall 155 may respectively be arranged on two sides of the second mounting section 153 in order to form the third mounting groove 151 and fourth mounting groove 152. Thus, when the upper frame 150 is coupled to the lower frame 140, the first sidewall 144 may be coupled to the third sidewall 154 while the second sidewall 145 may be coupled to the fourth sidewall 155 in order to form the first receiving cavity 110.

The sixth mounting groove 156 may further be provided at the third mounting groove 151. During assembly, one end of the magnetic element 120 may be embedded into the fifth mounting groove 146 of the lower frame 140. When the upper frame 150 is coupled with the lower frame 140, the fifth mounting groove 146 and the sixth mounting groove 156 may be precisely aligned with each other, allowing the other end of the magnetic element 120 to connect with and embedded into the sixth mounting groove 156 of the upper frame 150. This dual-end engagement may provide stable clamping and positioning, ensuring that the magnetic element 120 remains securely fixed within the first receiving cavity 110 without displacement or loosening. Meanwhile, the second mounting groove 142 and fourth mounting groove 152 may form the position limiting space 130, which may accurately secure the assembling panel 200, maintaining its stability throughout the assembling process.

The two ends of each magnetic element 120 may be connected to the fifth mounting groove 146 and the sixth mounting groove 156 respectively. Through shape conformity and interlocking engagement of the grooves, the magnetic elements 120 may be securely enclosed and locked within the first receiving cavity 110, preventing shaking or displacement during use and ensuring precise magnetic alignment and balanced magnetic force.

Referring to FIG. 4 to FIG. 8 of the drawings, at least one first locking slot 147 may be provided on the second sidewall 145, and at least one first locking latch 157 may be provided on the fourth sidewall 155. The first locking latch 157 may be detachably engaged with the first locking slot 147.

According to the preferred embodiment, to further enhance the stability of the detachable connection between the upper frame 150 and lower frame 140, and to ensure the structural reliability of the magnetic panel during assembling, the second sidewall 145 and fourth sidewall 155 may be configured to incorporate the first locking slot 147 and the first locking latch 157 respectively, which may be designed to interlock the upper frame 150 and lower frame 140 with each other. This configuration optimizes the connection method of the frame body 100, effectively addressing the issue of loosening commonly seen in traditional connection methods after prolonged use. It also improves the overall assembly convenience and stability.

Particularly, at least one first locking slot 147 may be provided on the second sidewall 145 of the lower frame 140, and at least one first locking latch 157 may be correspondingly provided on the fourth sidewall 155 of the upper frame 150. During assembly of the frame body, the upper frame 150 may be aligned with the corresponding position of the lower frame 140, and the first locking latch 157 may be smoothly engaged with the first locking slot 147, thereby quickly completing the connection and fixation between the upper frame 150 and the lower frame 140. This snap-fit structure is based on the mechanical interlocking principle, utilizing the tight engagement between the first locking latch 157 and the first locking slot 147 to form a mechanical locking effect. During engagement, the first locking latch 157 may undergoes elastic deformation, and upon full engagement, elastic recovery may ensure a firm interlock between the first locking latch 157 and the first locking slot 147. This provides a stable connection force and effectively restricts relative displacement between the upper frame 150 and the lower frame 140 after assembly.

The interlocking engagement between the first locking slot 147 and the first locking latch 157 may serve multiple functions. First, it may provide precise alignment between the upper frame 150 and the lower frame 140, ensuring accurate docking of the first mounting groove 141 with the third mounting groove 151, and the second mounting groove 142 with the fourth mounting groove 152. This may guarantee high installation accuracy for both the magnetic element 120 and the assembling panel 200. Second, compared to conventional snap-fit structures, this locking mechanism may enhance connection strength by optimizing the shape, dimensions, and tolerance fit between the slot and engaging portion. During use, especially under external forces such as pulling or impact from children's play, the interlocking structure may effectively distribute stress, prevent connection failure due to localized overload and maintaining the structural integrity of the magnetic panel. Additionally, the simple and tool-free snap-fit operation may improve assembly efficiency and facilitates future maintenance or component replacement.

The engagement between the first locking slot 147 and the first locking latch 157 may not only significantly shorten the connection time between the upper frame 150 and the lower frame 140, but may also substantially enhance the structural strength of the frame body 100. In practical use, children may freely assemble and build magnetic panel toys without concern over loosening of the upper frame 150 and the lower frame 140 that might affect the assembling experience or cause component detachment. Moreover, this secure connection method may improve the durability of the magnetic panel, extend the product's service life, and elevate the overall quality of the magnetic panel assembly toy 300.

Referring to FIG. 4 to FIG. 8 of the drawings, in one embodiment, a second locking slot 148 may be provided along the first sidewall 144, and a second locking rim 158 may be provided along the third sidewall 154. The second locking rim 158 may be detachably engaged with the second locking slot 148.

According to the preferred embodiment, to further enhance the connection reliability and structural integrity between the upper frame 150 and the lower frame 140, the second locking slot 148 and the second locking rim 158 may additionally be configured on the first sidewall 144 and third sidewall 154 respectively. This interlocking structure may reinforce the detachable connection of the frame body 100, this mitigating issues such as uneven force distribution or localized loosening that may arise from a single locking mechanism. As a result, the overall resistance to external forces is significantly improved.

According to the structural configuration, the second locking slot 148 may be arranged at the first sidewall 144 of the lower frame 140, while the second locking rim 158 may correspondingly be provided at the third sidewall 154 of the upper frame 150. During assembly of the frame body, the upper frame 150 and the lower frame 140 may be aligned with each other, such that the second locking rim 158 may precisely match and engage with the second locking slot 148. Leveraging fit tolerances and elastic deformation characteristics, the second locking rim 158 may be inserted into the second locking slot 148. This locking process may be based on the interference fit principle commonly used in mechanical engineering. As the second locking rim 158 is inserted, it may undergo elastic compression. Once fully inserted, the material's elastic recovery generates a retention force, resulting in a tight interlock between the two components and forming a stable mechanical connection. In other words, the second locking rim 158 may be made of deformable material, wherein the second locking rim 158 may be elastically compressed within the second locking slot 148 to secure the connection therebetween.

The second locking slot 148 and second locking rim 158 may form a secondary snap-fit pair that, together with the first locking slot 147 and first locking latch 157 on the second sidewall 145, thus establishing a spatially symmetrical constraint system. When the magnetic panel is subjected to external forces, this dual-symmetry snap-fit structure may distribute the load evenly across the four connection points of the upper frame 150 and the lower frame 140, thus preventing stress concentration that could otherwise lead to cracking of the upper frame 150 and/or the lower frame 140. Compared to traditional single snap-fit designs, this configuration may enhance the shear and torsional resistance of the frame connection interface by introducing an additional locking pair and optimizing the shape, dimensions, and fit tolerances. It may ensure that the first receiving cavity 110 and the position limiting space 130 maintain dimensional accuracy during repeated splicing and disassembly operations, thereby securing the installation positions of the magnetic elements 120 and assembling panel 200. Moreover, this dual snap-fit design does not compromise the quick assembly process of the upper frame 150 and the lower frame 140. Operators may complete both locking engagements simultaneously during standard alignment procedures, achieving a reliable connection of the frame body 100. Once assembled, the connection strength between the upper frame 150 and the lower frame 140 is significantly improved.

Referring to FIG. 4 to FIG. 8 of the drawings, adhesive material may be applied within the second locking slot 148, wherein the second locking rim 158 may be fixed in the second locking slot 148 via the adhesive.

To further enhance the connection stability between the upper frame 150 and lower frame 140, and to address potential loosening issues associated with purely mechanical snap-fit structures under extreme conditions or prolonged stress, this embodiment introduces a composite connection structure. By incorporating adhesive within the second locking slot 148, the design may combine mechanical interlocking with chemical bonding, thereby improving the overall reliability and durability of the frame body 100.

During assembly of the magnetic panel frame, an appropriate amount of adhesive may be pre-applied inside the second locking slot 148. The upper frame 150, which may include the second locking rim 158, may then be aligned with the lower frame 140 for installation. As the second locking rim 158 may be inserted into the second locking slot 148, the adhesive may uniformly fill the gap between the engaging portion and the slot. Leveraging the adhesive's adhesive properties, chemical bonds or intermolecular forces are formed at the interface, further enhancing the connection strength. Meanwhile, the mechanical snap-fit structure may ensure rapid preliminary positioning of the upper frame 150 and the lower frame 140, allowing the adhesive to maintain stable contact during curing and preventing misalignment that could compromise bonding effectiveness.

This composite connection method may integrate the dual advantages of mechanical constraint and chemical adhesion. The mechanical snap-fit portion, formed by the engagement between the second locking slot 148 and the second locking rim 158, provides initial connection rigidity and resistance to external forces, effectively limiting relative movement between the upper frame 150 and the lower frame 140. Meanwhile, the adhesive may fill the gaps that cannot be eliminated by mechanical structures, forming molecular-level bonding forces that eliminate loosening risks caused by tolerance variations. It may also distribute external stress evenly, preventing localized stress concentration. Through this interaction, the connection area may withstand tensile and torsional forces, relying on the rigid support of the mechanical structure and the adhesive bonding to prevent interface separation. This may significantly enhance the fatigue resistance and environmental adaptability of the overall frame structure.

Moreover, the use of adhesive does not significantly increase the assembly complexity. A simple adhesive application step added to the existing mechanical assembly process is sufficient to enhance connection performance, thereby balancing production efficiency with product quality.

Referring to FIG. 4 to FIG. 8 of the drawings, at least one positioning post 149 may be provided on a bottom wall of the first mounting groove 141, wherein the positioning post 149 may have a first positioning hole 1491 formed thereon.

Correspondingly, at least one mounting post 159 may be provided on the third mounting groove 151, wherein the mounting post 159 may be inserted into the positioning hole 1491.

According to the preferred embodiment, to further improve the positioning accuracy and structural stability during assembly of the magnetic panel, a cooperative structure may be established between the first mounting groove 141 and the third mounting groove 151, via the positioning post 149 and the mounting post 159. This configuration may enable precise alignment and reliable connection between the upper frame 150 and the lower frame 140 during assembling, thereby resolving issues such as displacement of the magnetic element 120 and structural loosening caused by assembly deviations. Moreover, at least one first reinforcing rib 1411 may be provided on an inner wall of the first mounting groove 141.

According to the preferred embodiment, considering that the first mounting groove 141 must withstand prolonged compression from the magnetic element 120 and external assembling forces during use of the magnetic panel, at least one first reinforcing rib 1411 may be provided along the inner wall of the first mounting groove 141 to enhance its structural strength and deformation resistance, thereby improving the overall mechanical performance and reliability of the frame body 100. Structurally, the first reinforcing rib 1411 may extend along the inner wall of the first mounting groove 141 and may be designed with a triangular, rectangular, or other cross-sectional profile based on mechanical requirements.

During assembly, the reinforcing rib 1411 may integrally be formed with the lower frame 140, ensuring close adherence to the groove wall. Once the magnetic element 120 is installed within the first receiving cavity 110, formed by the first mounting groove 141 and the third mounting groove 151, external forces during panel assembling may be transmitted through the magnetic element 120 to the mounting grooves. At this point, the reinforcing rib 1411, by virtue of its structural characteristics, may distribute concentrated stress across the groove wall. By altering the stress distribution and increasing the local moment of inertia, the rib enhances the bending stiffness and compressive strength of the groove wall, effectively suppressing deformation caused by applied forces.

At least one second reinforcing rib 1412 may be provided on an inner wall of the first mounting groove 141. One end of the second reinforcing rib 1412 may integrally be connected to the positioning post 149, and the opposed end may integrally be connected to the first reinforcing rib 1411. In other words, the positioning post 149 may be reinforced by the second reinforcing rib 1412.

According to the preferred embodiment, to further enhance the overall mechanical performance of the first mounting groove 141 and improve the structural stability of the frame body 100 when bearing the magnetic element 120 and resisting external assembling forces, the second reinforcing rib 1412 may be provided. This rib may structurally be connected to both the positioning post 149 and the first reinforcing rib 1411, forming an integrated support configuration. This design may address issues such as groove deformation and structural failure caused by localized stress concentration, thereby establishing a more rigid mechanical support system.

For structural configuration, at least one second reinforcing rib 1412 may be provided on the inner wall of the first mounting groove 141, wherein one end of the second reinforcing rib 1412 may securely be connected to the positioning post 149 and the opposed end is coupled to the first reinforcing rib 1411, thereby forming a three-dimensional reinforcement network. The second reinforcing rib 1412 may integrally be formed with the lower frame 140 to ensure high connection strength. During use of the magnetic panel, the magnetic force generated by the magnetic element 120 and external assembling forces may act upon the first mounting groove 141. At this point, the second reinforcing rib 1412 may work in coordination with the first reinforcing rib 1411 and the positioning post 149. Through its connection to the positioning post 149, the second reinforcing rib 1412 may help distributing axial and shear forces, while its linkage to the first reinforcing rib 1411 may further enhance the overall stiffness of the groove wall, enabling uniform stress distribution across the reinforcement network. This multi-component collaborative design departs from traditional single-rib reinforcement approaches by establishing a three-dimensional mechanical support architecture, which significantly improves the deformation resistance of the first mounting groove 141.

During use, even when the magnetic panel is subjected to significant external impact or prolonged operational stress, the presence of the reinforcement rib network within the first mounting groove 141 effectively limits deformation and ensures the positional stability of the magnetic element 120. This structural enhancement also improves the fatigue resistance of the overall frame and extends the service life of the magnetic panel.

Referring to FIG. 4 to FIG. 8 of the drawings, at least one third reinforcing rib 1511 may be provided on an inner wall of the third mounting groove 151.

In one embodiment, at least one fourth reinforcing rib 1512 may be provided on the inner wall of the third mounting groove 151. One end of the fourth reinforcing rib 1512 may integrally be connected to the mounting post 159, and the opposed end of the fourth reinforcing rib 1512 is integrally connected to the third reinforcing rib 1511.

It is understood that the reinforcing ribs provided on the upper frame 150 and lower frame 140 may be based on the same structural principle, and therefore will not be repeated here.

In one embodiment, at least one first positioning block 1421 may be provided on the second mounting groove 142, wherein the first positioning block 1421 may be configured to engage with one of second positioning holes 210 formed on the edge of the assembling panel 200, thereby securing the assembling panel 200 in position.

To further improve the installation accuracy and fixation reliability of the assembling panel 200 within the position limiting space 130, and to address issues such as displacement and misalignment commonly seen in conventional assembly methods, the first positioning blocks 1421 may be provided on the second mounting groove 142. These first positioning blocks 1421 may be configured to engage with the second positioning holes 210 formed on the assembling panel 200, thereby achieving precise and secure positioning of the assembling panel 200.

For structural configuration, at least one first positioning block 1421 may be provided on the inner wall of the second mounting groove 142, with its shape and dimensions configured to match the second positioning hole 210 formed on the assembling panel 200. During assembly, the edge of the assembling panel 200 may be placed into the second mounting groove 142, allowing the first positioning block 1421 to accurately engage with the second positioning hole 210. This mechanism is based on the locating pin principle commonly used in mechanical assembly, utilizing an interference fit or transition fit between the first positioning block 1421 and the second positioning hole 210 to restrict horizontal movement of the edge of the assembling panel 200 within the position limiting space 130. In addition to its positioning function, the first positioning block 1421 may also partially bear external forces during splicing operations. It may help distributing insertion and compression forces exerted on the assembling panel 200 to the walls of the second mounting groove 142, thereby preventing deformation or loosening caused by uneven stress.

During actual assembly, the engagement between the first positioning block 1421 and the second positioning hole 210 may greatly simplify the installation process of the assembling panel 200. Operators need only to align the second positioning hole 210 on the assembling panel 200 with the first positioning block 1421 to quickly complete preliminary positioning, followed by assembling of the upper frame 150 and lower frame 140. This streamlined procedure ensures both case of operation and precise alignment. The positioning structure significantly enhances the structural stability of the magnetic panel. Testing shows that the displacement of the assembling panel 200 under typical assembling forces remains minimal, with anti-loosening performance improved by approximately 50% compared to panels without positioning features. Furthermore, accurate positioning ensures flatness and consistency between adjacent magnetic panels during assembling, effectively improving the overall quality and user experience of the magnetic panel assembly toy 300 and maintaining reliable performance throughout long-term use.

Referring to FIG. 4 to FIG. 8 of the drawings, at least one second positioning block 1521 may be provided on the inner wall of the fourth mounting groove 152, wherein the second positioning block 1521 may be configured to engage with the second positioning hole 210 formed on the assembling panel 200, thereby securing the assembling panel 200 in position. In other words, the first positioning block 1421 and the second positioning block 1521 may be aligned with each other and are engaged with the same second positioning hole 210. Therefore, each second positioning hole 210 may receive both the first positioning block 1421 and the second positioning block 1521.

It is understood that the positioning blocks provided on the upper frame 150 and lower frame 140 may be based on the same structural principle and will not be repeated here.

In addition, a smooth transitional interface may be adopted between the first mounting portion 143 and the first sidewall 144 to form a round interface therebetween.

Likewise, a smooth transitional interface may be adopted between the second mounting portion 153 and the third sidewall 154 to form a round interface therebetween.

The end portions of the frame side edges may be configured with smooth transitions, such that the frame body has a round frame edge.

To enhance the safety and manufacturing feasibility of the magnetic panel frame, this embodiment addresses issues commonly found in traditional frame structures, such as sharp corners that may cause impact injuries or lead to stress concentration. By implementing smooth transitional interfaces between the first mounting portion 143 and the first sidewall 144, the second mounting portion 153 and the third sidewall 154, as well as at the end portions of the frame side edges, the structural details of the frame body 100 are optimized. This design not only effectively mitigates safety risks during use but also improves the mechanical performance and process compatibility of the product.

For structural configuration, rounded corner processing may be applied at the junction between the first mounting portion 143 and the first sidewall 144, as well as between the second mounting portion 153 and the third sidewall 154. The end portions of the frame side edges may also be formed with a rounded profile. During actual manufacturing, this smooth transition may be achieved by incorporating rounded mold features during injection molding or by performing chamfering operations after machining metal frames, resulting in continuous and smooth curved surfaces at each transition point. From a mechanical perspective, sharp corners tend to cause stress concentration under load. In contrast, the rounded transition design increases the force-bearing area and eliminates abrupt interface changes, thereby effectively dispersing external forces and reducing the risk of material cracking. For example, when the frame is subjected to external impact or compression, the curved geometry allows stress to be evenly transmitted along the surface, preventing localized overload and structural damage, and enhancing the overall impact resistance of the frame.

In practical use, the rounded transition design may significantly enhance product safety. For the magnetic panel assembly toy 300 intended for children, it effectively eliminates risks of scratches and collisions caused by sharp corners, thereby complying with child product safety standards. Thus, this design improves the assembly process by reducing interference from burrs or sharp edges during the splicing of the upper frame 150 and the lower frame 140, resulting in smoother component engagement and improved assembly efficiency and yield rate. From an aesthetic and manufacturing perspective, the rounded corner geometry lends the frame smoother contours and a more refined appearance, enhancing the product's overall texture and market competitiveness. This approach successfully balances functionality with visual appeal.

Figure 3:
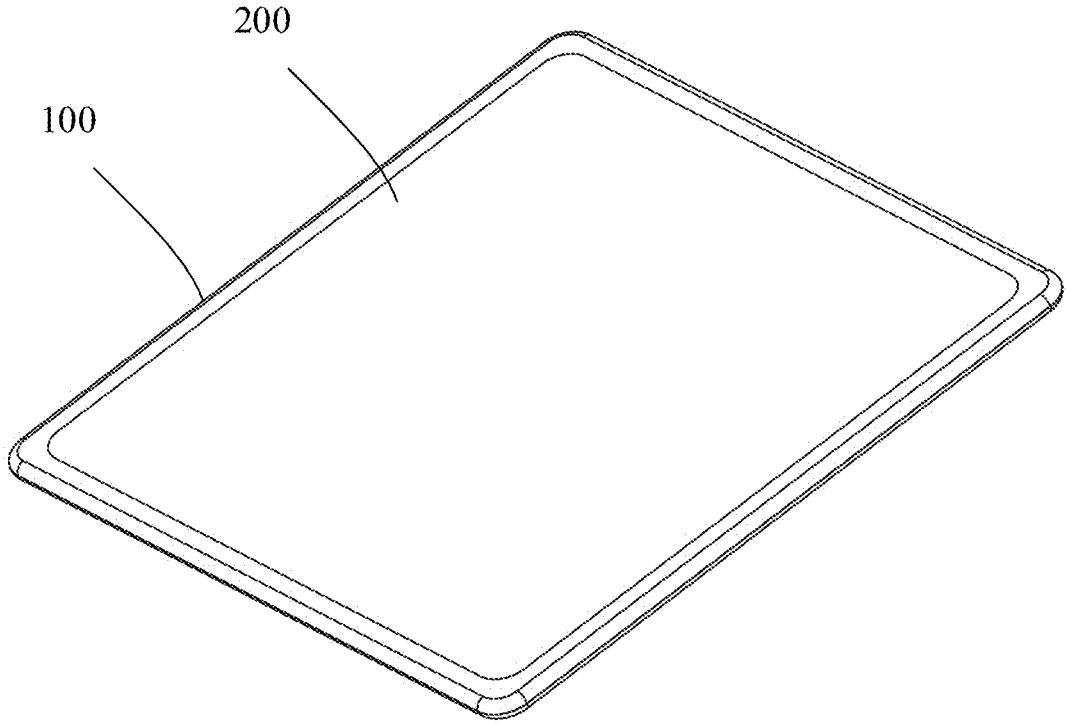
FIG. 3 is a schematic view of a magnetic panel of the assembly toy according to the above preferred embodiment of the present invention.
Figure 4:
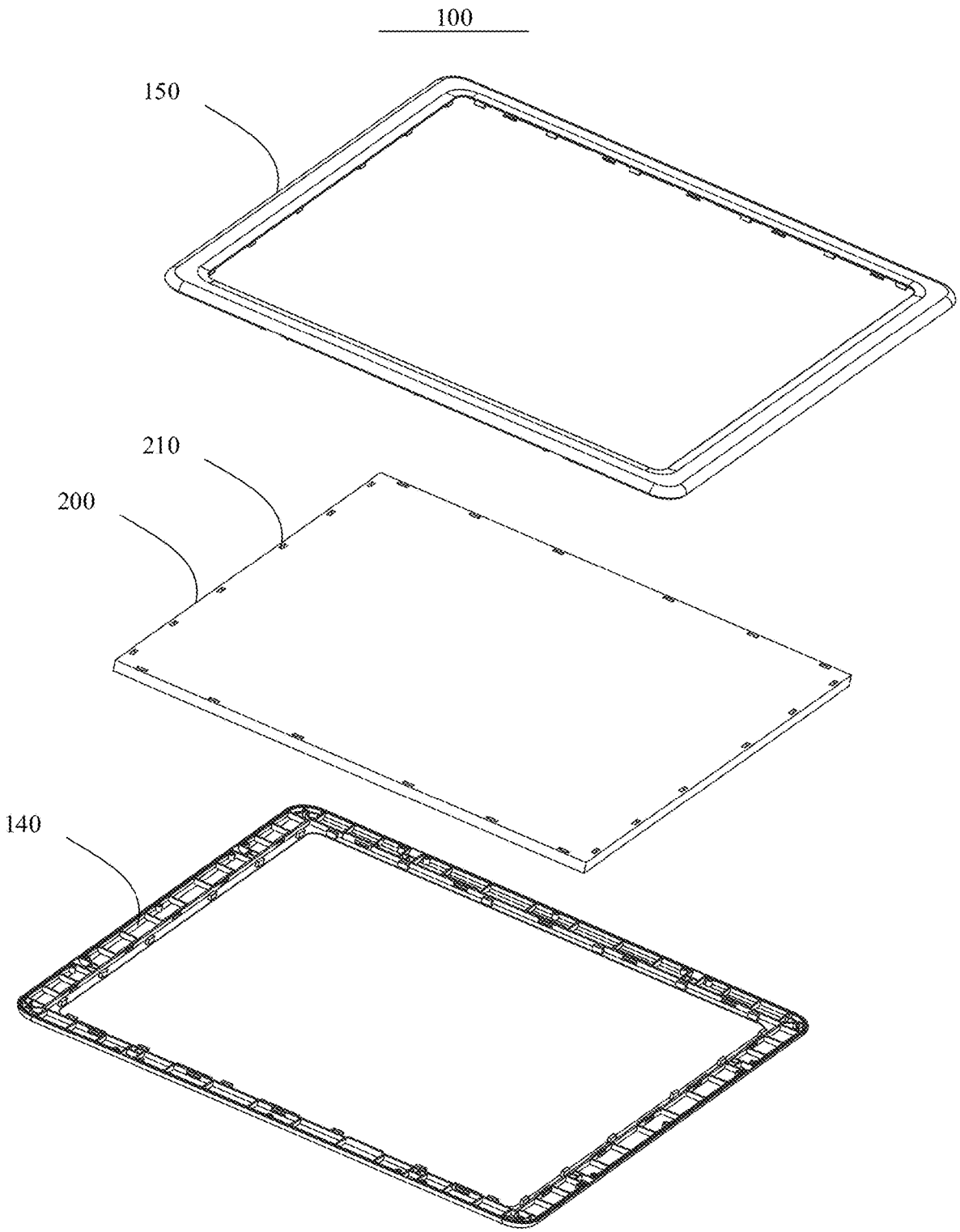
FIG. 4 is an exploded perspective view of the magnetic panel of the assembly toy according to the above preferred embodiment of the present invention.
Figure 5:
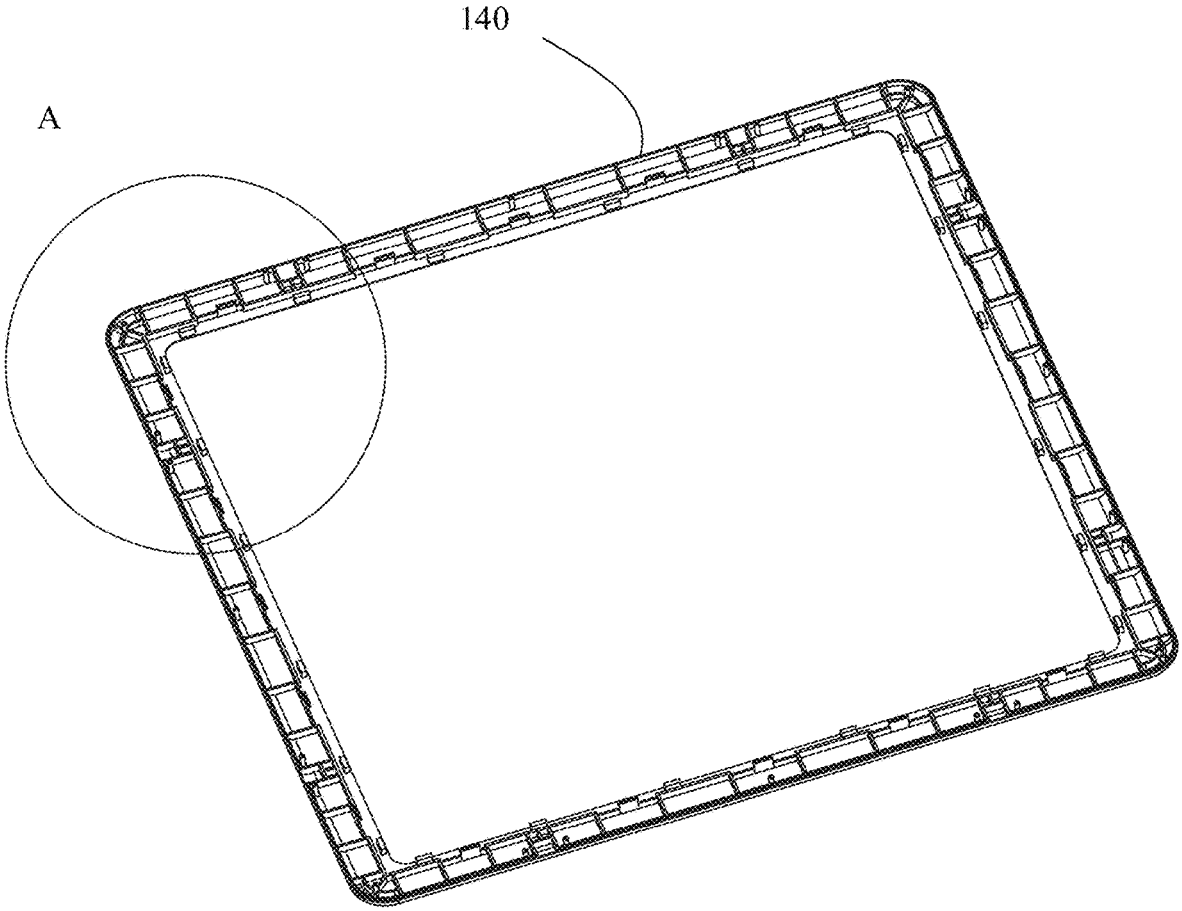
FIG. 5 is a schematic view of an upper frame of the magnetic panel of the assembly toy according to the above preferred embodiment of the present invention.
Figure 6:
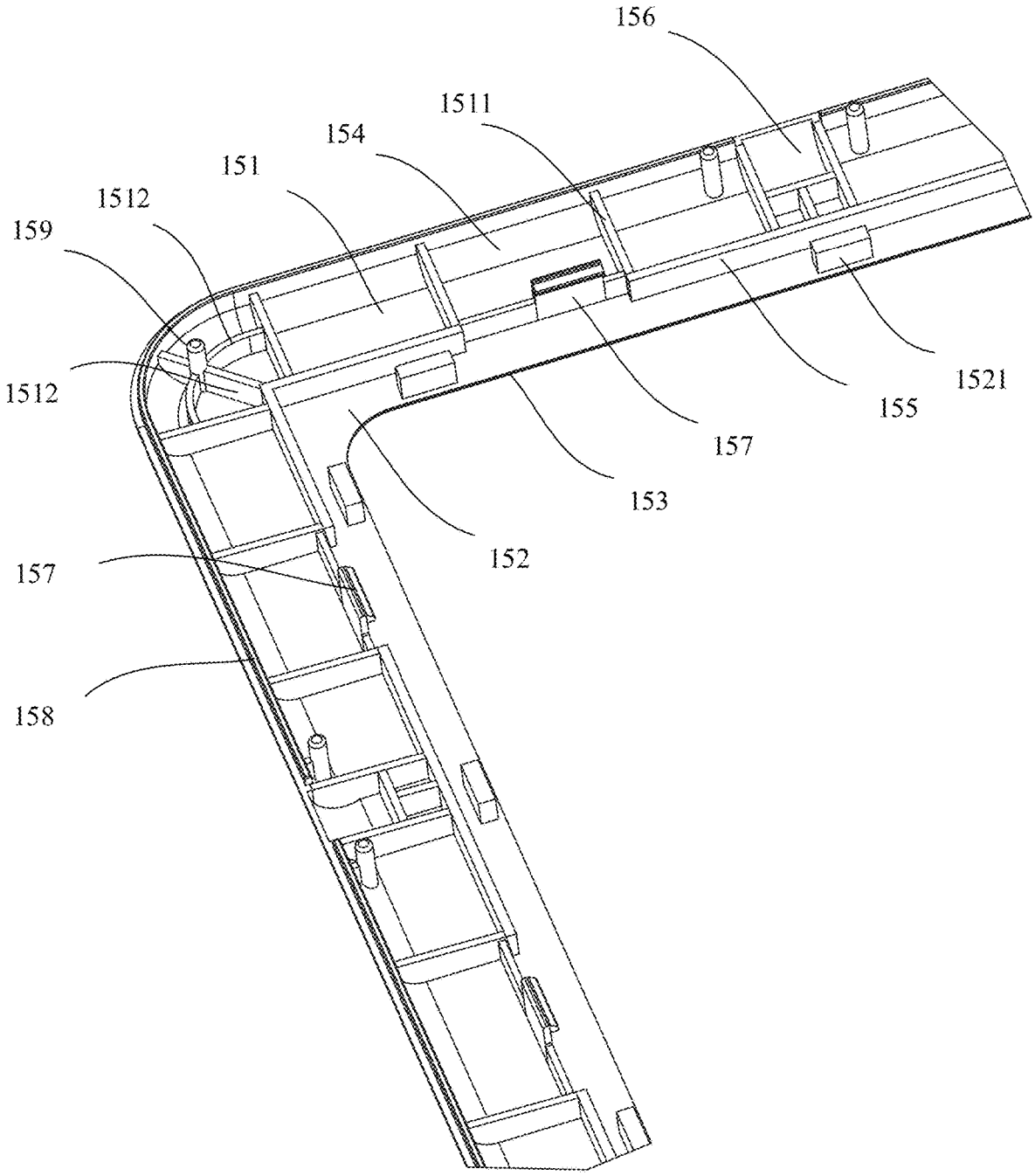
FIG. 6 is an enlarged schematic view of the upper frame of the magnetic panel of the assembly toy taken at an area 'A' in FIG. 5 according to the above preferred embodiment of the present invention.
Figure 7:
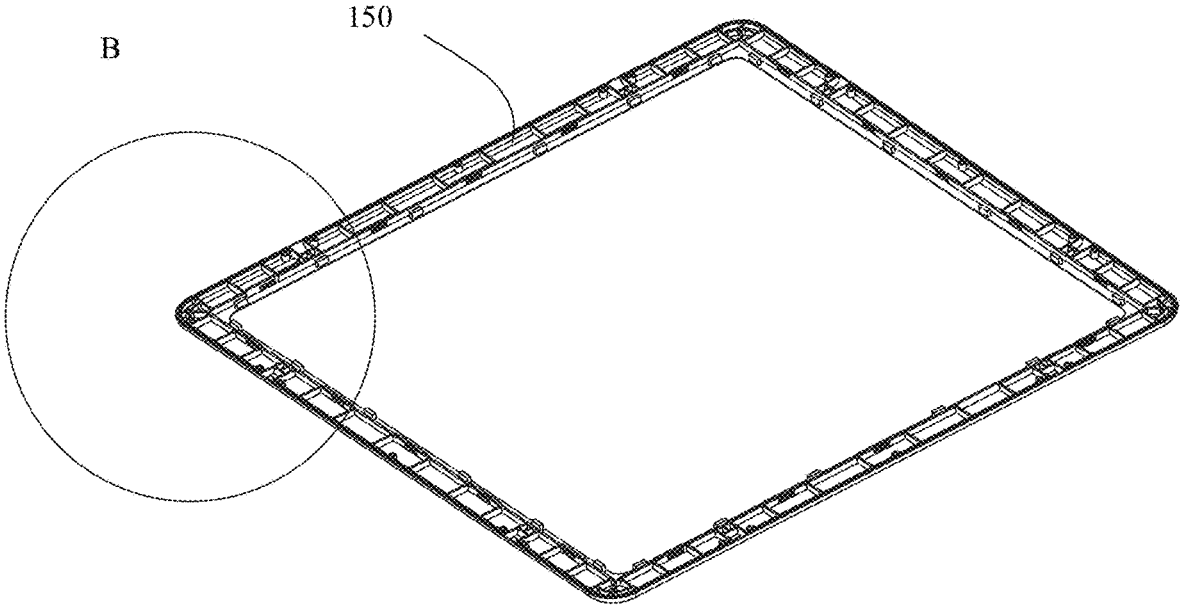
FIG. 7 is a schematic view of a lower frame of the magnetic panel of the assembly toy according to the above preferred embodiment of the present invention.
Figure 8:
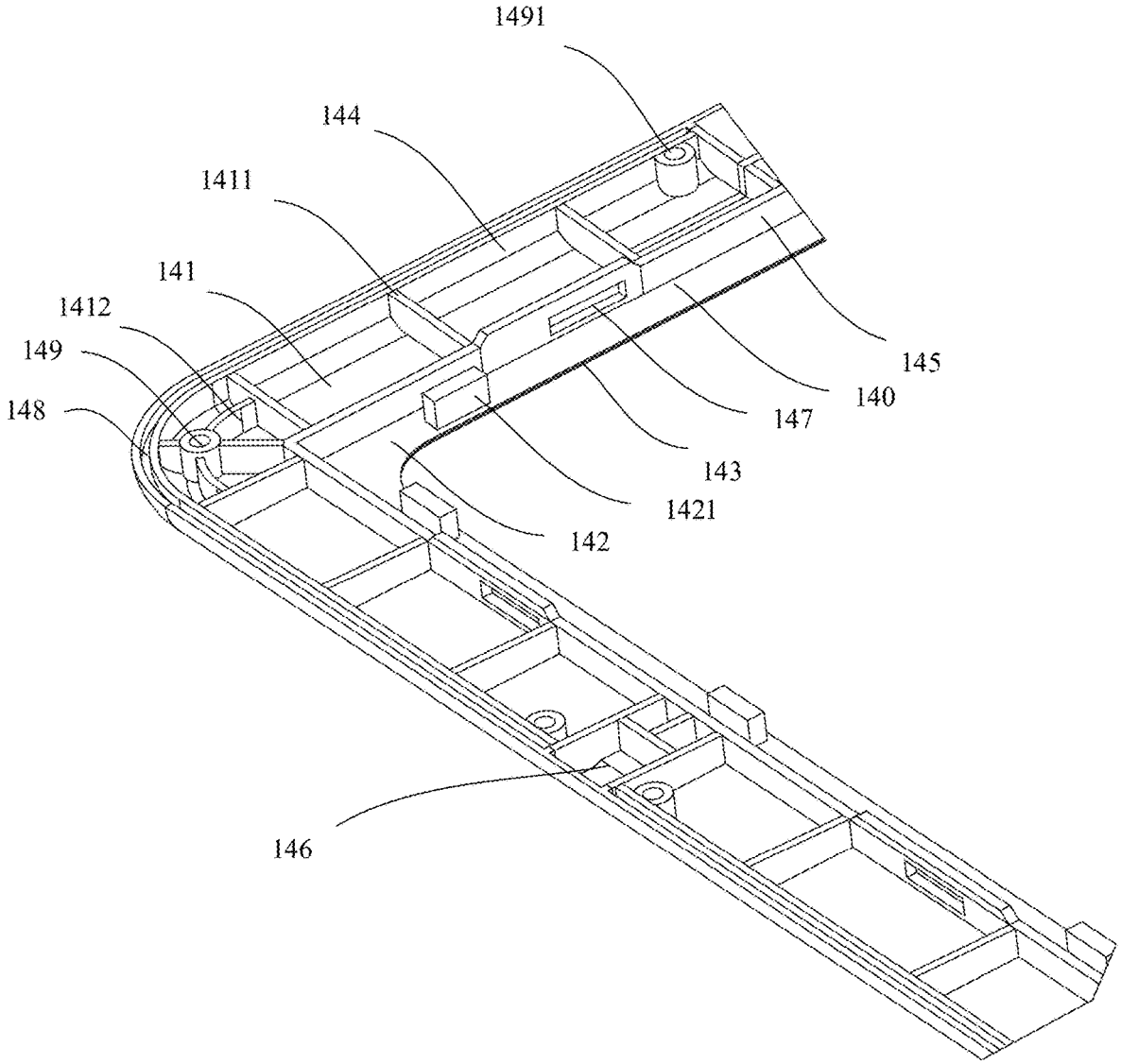
FIG. 8 is an enlarged schematic view of the upper frame of the magnetic panel of the assembly toy taken at an area 'B' in FIG. 7 according to the above preferred embodiment of the present invention.

Referring to FIG. 3 to FIG. 4 of the drawings, the present invention may further comprise a magnetic assembling panel, which is constructed by the aforementioned frame body 100 and the assembly panel 200. The detailed structure of the frame corresponds to the embodiments described above. Since this subject adopts all the technical solutions of the preceding embodiments, it inherently possesses all the beneficial effects associated with those solutions, which will not be repeated here. The edge of the assembly panel 200 is arranged within the position limiting space 130. The magnetic assembly panel may configure in various shapes, such as rectangular, triangular, polygonal, or other irregular geometries.

According to the preferred embodiment, at least one second positioning hole 210 may be provided along the edge of the assembly panel 200, and the first positioning block 1421 and/or the second positioning block 1521 may be inserted into the second positioning hole 210.

Alternatively, the assembly panel 200 may be provided with an opening 220, which allows for variation in the form of the magnetic panel, thereby enhancing its playability.

Figure 9:
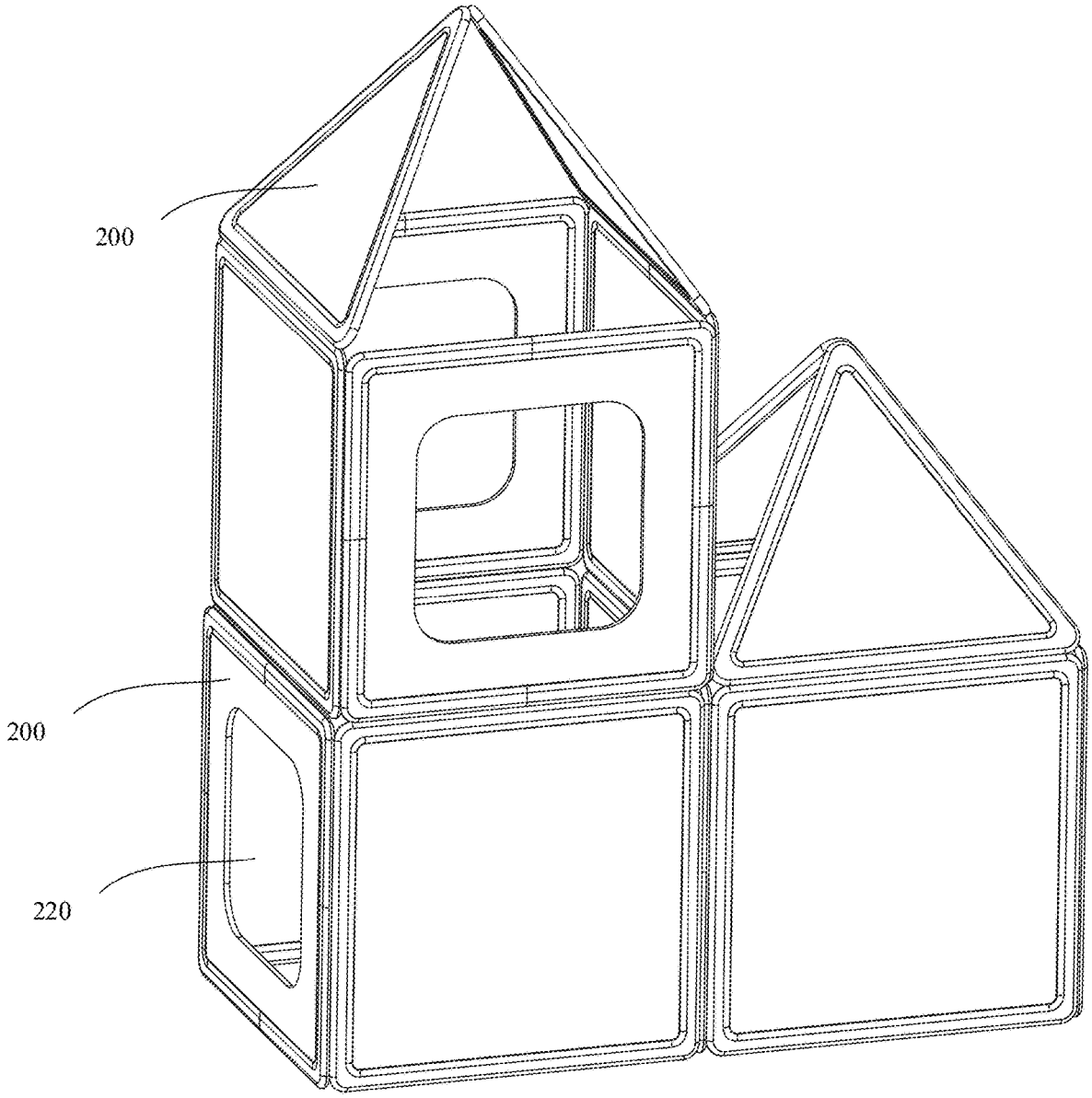
FIG. 9 is a schematic view of the assembly toy according to the above preferred embodiment of the present invention.

Referring to FIG. 9 of the drawings, the present invention may further comprise an assembly toy 300, which may be constructed by the aforementioned frame body and/or magnetic assembling panel. The assembly toy 300 may be assembled by interconnecting the frame or magnetic assembling panels edge-to-edge.

The technical solution of the present invention adopts a configuration in which the first receiving cavity 110 may be formed in the frame body 100, and a magnetic element 120 may be arranged within the receiving cavity. The position limiting space 130 may be defined on the inner edge of the frame body 100 for mounting the panel. By placing the panel within the position limiting space 130, assembly can be completed efficiently, thereby improving the assembly efficiency of the magnetic panel The present invention, while illustrated and described in terms of a preferred embodiment and several alternatives, is not limited to the particular description contained in this specification. Additional alternative or equivalent components could also be used to practice the present invention.

What is claimed is:

1. A magnetic assembling panel, comprising:

an assembling panel; and a frame for framing the assembling panel, wherein the frame comprises at least one magnetic element, and a frame body having a receiving cavity receiving the magnetic element therein and a position limiting space formed at an inner edge of the frame body to receive an edge of the assembling panel;

wherein the frame body comprises:

a lower frame having a first mounting groove and a second mounting groove;

an upper frame having a third mounting groove and a fourth mounting groove; and an interlock mechanism interlocking the upper frame and the lower frame with each other, wherein when the upper frame and the lower frame are coupled with each other, the first mounting groove and the third mounting groove form the receiving cavity while the second mounting groove and the fourth mounting groove form the position limiting space to receive the edge of the assembling panel;

wherein the lower frame further has a first mounting section, a first sidewall formed along one edge of the first mounting portion, and a second sidewall spaced apart from the first sidewall, wherein the first mounting groove is formed between the first sidewall and the second sidewall;

wherein the upper frame further has a second mounting section, a third sidewall formed along one edge of the second mounting portion, and a fourth sidewall spaced apart from the third sidewall, wherein the third mounting groove is formed between the third sidewall and the fourth sidewall;

wherein when the upper frame is coupled with the lower frame, the first sidewall is coupled with the third sidewall while the second sidewall is coupled with the fourth sidewall in order to form the receiving cavity.

2. The magnetic assembling panel, as recited in claim 1, wherein the lower frame further has a fifth mounting groove formed in the first mounting groove, wherein the upper frame further has a sixth mounting groove formed in the third mounting groove, wherein the fifth mounting groove and the sixth mounting groove are aligned with each other when the upper frame and lower frame are coupled with each other.

3. The magnetic assembling panel, as recited in claim 2, wherein one end of the magnetic element is received at the fifth mounting groove while an opposed end of the magnetic element is received at the sixth mounting groove.

4. The magnetic assembling panel, as recited in claim 1, wherein the interlock mechanism comprises at least one first locking slot provided on the second sidewall, and at least one first locking latch provided on the fourth sidewall, wherein the first locking latch is detachably engaged with the first locking slot to interlock the upper frame and the lower frame with each other.

5. The magnetic assembling panel, as recited in claim 4, wherein the interlock mechanism further comprises a second locking slot provided along the first sidewall and a second locking rim provided along the third sidewall, wherein the second locking rim is detachably engaged with the second locking slot to interlock the upper frame and the lower frame with each other.

6. The magnetic assembling panel, as recited in claim 5, wherein the second locking rim is made of deformable material, such that the second locking rim is elastically compressed within the second locking slot to secure a connection therebetween.

7. The magnetic assembling panel, as recited in claim 4, wherein the interlock mechanism further comprises at least one positioning post, having a first positioning hole, provided on a bottom wall of the first mounting groove, and at least one mounting post provided on the third mounting groove, wherein the mounting post is inserted into the positioning hole of the positioning post to position and interlock the upper frame and the lower frame with each other.

8. The magnetic assembling panel, as recited in claim 7, wherein the lower frame further comprises at least one first reinforcing rib is provided on an inner wall of the first mounting groove and at least one second reinforcing rib is provided on the inner wall of the first mounting groove, wherein one end of the second reinforcing rib is integrally connected to the positioning post while an opposed end is integrally connected to the first reinforcing rib.

9. The magnetic assembling panel, as recited in claim 7, wherein the upper frame further comprises at least one third reinforcing rib provided on an inner wall of the third mounting groove, and at least one fourth reinforcing rib provided on the inner wall of the third mounting groove, wherein one end of the fourth reinforcing rib is integrally connected to the mounting post while an opposed end of the fourth reinforcing rib is integrally connected to the third reinforcing rib.

10. A magnetic assembling panel, comprising:

an assembling panel; and a frame for framing the assembling panel, wherein the frame comprises at least one magnetic element, and a frame body having a receiving cavity receiving the magnetic element therein and a position limiting space formed at an inner edge of the frame body to receive an edge of the assembling panel;

wherein the frame body comprises:

a lower frame having a first mounting groove and a second mounting groove;

an upper frame having a third mounting groove and a fourth mounting groove; and an interlock mechanism interlocking the upper frame and the lower frame with each other, wherein when the upper frame and the lower frame are coupled with each other, the first mounting groove and the third mounting groove form the receiving cavity while the second mounting groove and the fourth mounting groove form the position limiting space to receive the edge of the assembling panel;

wherein the frame body further comprises a plurality of first positioning blocks spacedly formed on an inner wall of the second mounting groove and a plurality of second positioning blocks spacedly formed on an inner wall of the fourth mounting groove, wherein the assembling panel has a plurality of second positioning holes spacedly formed along the edge of the assembling panel, wherein the first positioning blocks and the second positioning blocks are engaged with the second positioning holes to securely couple the edge of the assembling panel at the position limiting space of the frame body.

11. The magnetic assembling panel, as recited in claim 10, wherein the first positioning blocks and the second positioning blocks are aligned with each other when the upper frame and the lower frame are coupled with each other.

12. An assembly toy, comprising:

a plurality of magnetic assembling panels magnetically coupled with each other edge-to-edge, wherein each of the magnetic assembling panels comprises an assembling panel and a frame for framing the assembly panel, wherein the frame comprises at least one magnetic element and a frame body having a receiving cavity receiving the magnetic element therein and a position limiting space formed at an inner edge of the frame body to receive an edge of the assembling panel;

wherein the frame body comprises a lower frame having a first mounting groove and a second mounting groove, and an upper frame having a third mounting groove and a fourth mounting groove, wherein when the upper frame and the lower frame are coupled with each other, the first mounting groove and the third mounting groove form the receiving cavity while the second mounting groove and the fourth mounting groove form the position limiting space to receive the edge of the assembling panel;

wherein the lower frame further has a first mounting section, a first sidewall formed along one edge of the first mounting portion, and a second sidewall spaced apart from the first sidewall, wherein the first mounting groove is formed between the first sidewall and the second sidewall;

wherein the upper frame further has a second mounting section, a third sidewall formed along one edge of the second mounting portion, and a fourth sidewall spaced apart from the third sidewall, wherein the third mounting groove is formed between the third sidewall and the fourth sidewall;

wherein when the upper frame is coupled with the lower frame, the first sidewall is coupled with the third sidewall while the second sidewall is coupled with the fourth sidewall in order to form the receiving cavity.

13. The assembly toy, as recited in claim 12, wherein the magnetic element is disposed in the receiving cavity at a position that one end of the magnetic element is received in the first mounting groove between the first sidewall and the second sidewall while an opposed end of the magnetic element is received in the third mounting groove between the third sidewall and the fourth sidewall.

14. The assembly toy, as recited in claim 12, further comprising:

at least one first locking slot provided on the second sidewall; and at least one first locking latch provided on the fourth sidewall, wherein the first locking latch is detachably engaged with the first locking slot to interlock the upper frame and the lower frame with each other.

15. The assembly toy, as recited in claim 14, further comprising:

a second locking slot provided along the first sidewall; and a second locking rim provided along the third sidewall, wherein the second locking rim is detachably engaged with the second locking slot to interlock the upper frame and the lower frame with each other.

16. The assembly toy, as recited in claim 15, further comprising:

at least one positioning post, having a first positioning hole, provided on a bottom wall of the first mounting groove; and at least one mounting post provided on the third mounting groove, wherein the mounting post is inserted into the positioning hole of the positioning post to position and interlock the upper frame and the lower frame with each other.

17. The assembly toy, as recited in claim 12, wherein the frame body further comprises a plurality of first positioning blocks spacedly formed on an inner wall of the second mounting groove and a plurality of second positioning blocks spacedly formed on an inner wall of the fourth mounting groove, wherein the assembling panel has a plurality of second positioning holes spacedly formed along the edge of the assembling panel, wherein the first positioning blocks and the second positioning blocks are engaged with the second positioning holes to securely couple the edge of the assembling panel at the position limiting space of the frame body.

18. The assembly toy, as recited in claim 17, wherein the first positioning blocks and the second positioning blocks are aligned with each other when the upper frame and the lower frame are coupled with each other.

* * * * *